US011833653B2

(12) United States Patent
Machida

(10) Patent No.: US 11,833,653 B2
(45) Date of Patent: Dec. 5, 2023

(54) POWER TOOL HAVING HAMMER MECHANISM

(71) Applicant: MAKITA CORPORATION, Anjo (JP)

(72) Inventor: Yoshitaka Machida, Anjo (JP)

(73) Assignee: MAKITA CORPORATION, Anjo (JP)

( * ) Notice: Subject to any disclaimer, the term of this patent is extended or adjusted under 35 U.S.C. 154(b) by 43 days.

(21) Appl. No.: 17/668,059

(22) Filed: Feb. 9, 2022

(65) Prior Publication Data

US 2022/0266435 A1 Aug. 25, 2022

(30) Foreign Application Priority Data

Feb. 22, 2021 (JP) ..... 2021-025937

(51) Int. Cl.
*B25D 17/04* (2006.01)
*B25D 16/00* (2006.01)

(52) U.S. Cl.
CPC ..... *B25D 17/043* (2013.01); *B25D 16/00* (2013.01); *B25D 2250/121* (2013.01); *B25D 2250/371* (2013.01)

(58) Field of Classification Search
CPC ..... B25F 5/006; B25G 1/01; B25D 2250/121; B25D 2250/371; B25D 16/00; B25D 17/24; B25D 17/043; B25D 17/04
See application file for complete search history.

(56) References Cited

U.S. PATENT DOCUMENTS 4,936,394 A * 6/1990 Ohtsu ..... B25F 5/006 267/137
5,692,574 A * 12/1997 Terada ..... B25D 17/043 173/162.2
6,286,610 B1 * 9/2001 Berger ..... B25F 5/006 173/162.1
6,913,088 B2 * 7/2005 Berger ..... B25D 17/043 173/48
7,886,838 B2 2/2011 Hahn
8,069,930 B2 * 12/2011 Engelfried ..... B25D 17/043 173/162.1
8,240,395 B2 * 8/2012 Kamegai ..... B25D 17/04 173/162.1

(Continued)

FOREIGN PATENT DOCUMENTS

DE 102009002969 A1 * 11/2010 ..... B24B 23/028

*Primary Examiner* — Joshua G Kotis
(74) *Attorney, Agent, or Firm* — Oliff PLC

(57) ABSTRACT

A power tool includes a tool body, a motor, a handle, at least one biasing member, and at least one guide part. The handle is connected to the tool body to be pivotable and to be movable in at least a front-rear direction relative to the tool body. The handle includes a cover part covering a portion of the tool body and a grip part extending in a cantilever manner from the cover part. The at least one biasing member biases the tool body and the handle away from each other in the front-rear direction. The at least one guide part includes a first portion disposed on a portion of the tool body covered by the cover part, and a second portion disposed on the cover part of the handle and connected to the first portion to be movable in at least the front-rear direction relative to the first portion.

15 Claims, 10 Drawing Sheets

(56) References Cited

U.S. PATENT DOCUMENTS

| | | | | |
|---|---|---|---|---|
| 8,695,724 | B2 * | 4/2014 | Nakashima | B25F 5/006 173/210 |
| 9,168,652 | B2 * | 10/2015 | Schadow | B25F 5/006 |
| 9,434,062 | B2 * | 9/2016 | Kamegai | B25D 17/20 |
| 9,999,967 | B2 * | 6/2018 | Furusawa | B25D 17/043 |
| 2007/0295522 | A1 * | 12/2007 | Bohne | B25D 17/24 173/162.2 |
| 2011/0011608 | A1 * | 1/2011 | Saur | B25D 11/062 173/162.2 |
| 2012/0118599 | A1 * | 5/2012 | Schadow | B25F 5/006 173/162.2 |
| 2015/0144366 | A1 * | 5/2015 | Machida | B25D 16/00 173/104 |
| 2019/0061132 | A1 * | 2/2019 | Mori | B23D 51/16 |

* cited by examiner

POWER TOOL HAVING HAMMER MECHANISM

CROSS-REFERENCE TO RELATED APPLICATION

The present application claims priority to Japanese patent application No. 2021-025937 filed on Feb. 22, 2021, the contents of which are hereby fully incorporated herein by reference.

TECHNICAL FIELD

The present disclosure relates to a power tool having a hammer mechanism that is configured to linearly drive a tool accessory.

BACKGROUND

A power tool having a hammer mechanism, which is configured to linearly drive a tool accessory along a driving axis to perform a processing operation on a workpiece, generates significant vibration especially in an extension direction of the driving axis. In order to cope with the vibration, various vibration-isolating housings are known. For example, a power tool (an electric hammer) having a hammer mechanism that is disclosed in U.S. Pat. No. 7,886,838 includes a handle and a body. The handle has a grip part, and is movable in an extension direction of a driving axis pivotable relative to the body.

SUMMARY

In the above-described power tool, two end portions of the elongate grip part are both connected to the body or to other portions of the handle. On the other hand, there are other power tools that include a grip part having a free end (a so-called a cantilever-type grip part).

It is a non-limiting object of the present disclosure to provide techniques that can reduce vibration transmission to a handle having a cantilever-type grip part in a power tool having a hammer mechanism.

One aspect of the present disclosure herein provides a power tool having a hammer mechanism, which is configured to linearly drive a tool accessory along a driving axis that defines a front-rear direction. The power tool includes a tool body, a motor, a handle, at least one biasing member, and at least one guide part.

The tool body extends along the driving axis. The motor is housed in the tool body. The motor has a motor shaft that is pivotable around an axis parallel to the driving axis. The handle is connected to the tool body such that the handle is pivotable relative to the tool body and is also movable in at least the front-rear direction relative to the tool body. The handle includes a cover part and a grip part. The cover part has a cylindrical shape at least in part and covers a portion of the tool body. The grip part extends in a cantilever manner from the cover part in a direction that intersects the driving axis. It is noted that the feature that "the grip part extends in a cantilever manner from the cover part" may be rephrased that only one end of the grip part is connected to the cover part and the other end of the grip part is a free end.

The at least one biasing member is disposed (interposed) between the tool body and the handle. The at least one biasing member is configured to bias the tool body and the handle away from each other in the front-rear direction. The at least one guide part includes a first portion and a second portion. The first portion is disposed on(in) a portion of the tool body covered by the cover part. The second portion is disposed on(in) the cover part of the handle. The second portion is connected to the first portion to be movable in at least the front-rear direction relative to the first portion.

According to the above-described configuration, the first and second portions of the guide part can move in the front-rear direction relative to each other in response to vibration in the front-rear direction that is generated when the tool accessory is driven (i.e., major vibration caused in the extension direction of the driving axis). Therefore, the handle including the cantilever grip part can move in the front-rear direction relative to the tool body. Also at this time, the at least one biasing member can absorb the vibration in the front-rear direction. Thus, transmission of the vibration in the front-rear direction from the tool body to the handle can be effectively reduced. Further, since the tool body and the handle are pivotable relative to each other, transmission of vibration in the direction of relative pivotal movement thereof can be also reduced.

DESCRIPTION OF EMBODIMENTS

Figure 1:
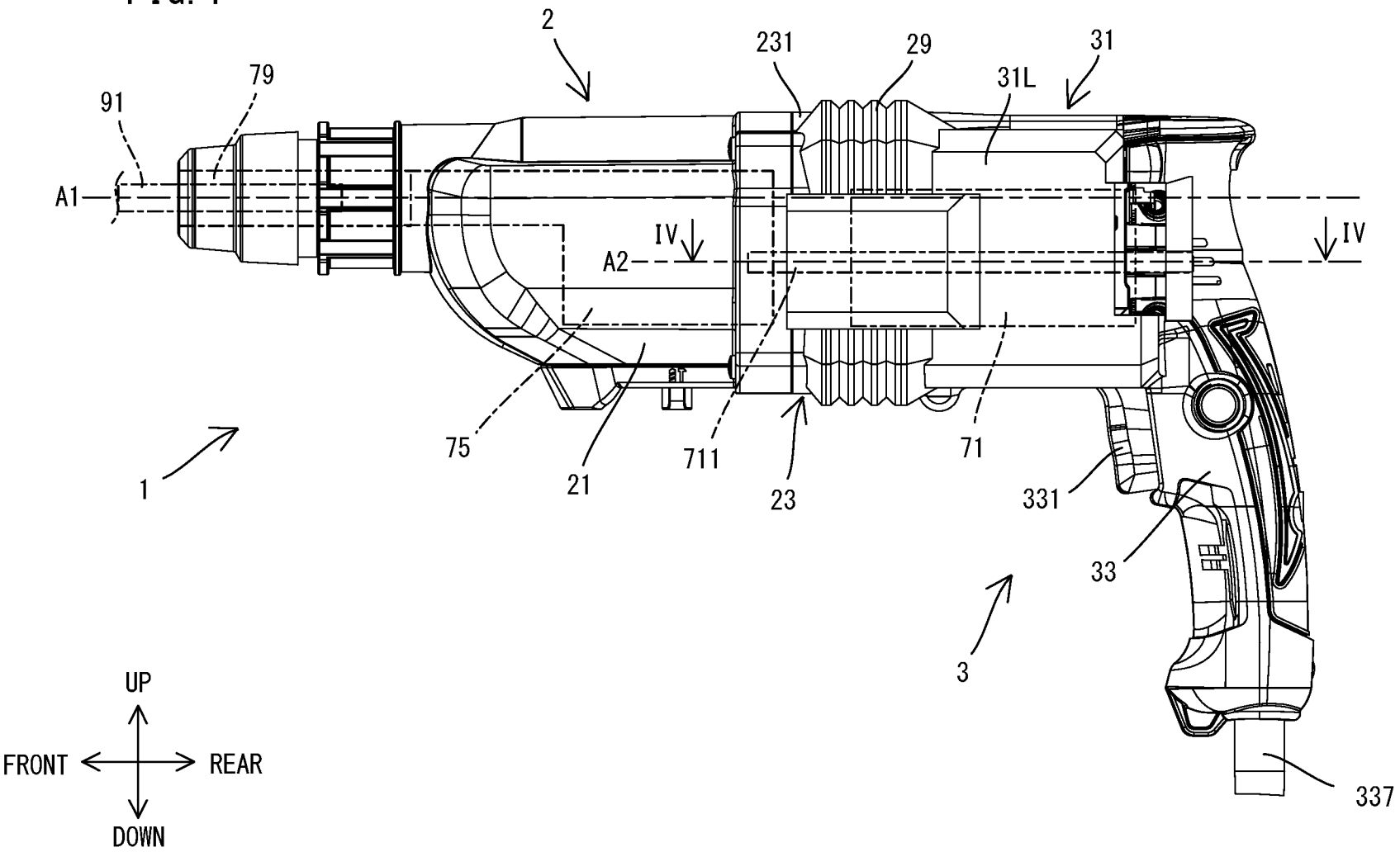
FIG. 1 is a left side view of a rotary hammer in a state in which a handle is at (in) an initial position.

In one non-limiting embodiment according to the present disclosure, the at least one guide part may be configured to allow the handle to move relative to the tool body in the front-rear direction and in a direction intersecting the driving axis. According to this embodiment, the at least one guide part can reduce not only transmission of the major vibration in the front-rear direction but also transmission of vibration in the direction intersecting the driving axis.

In addition or in the alternative to the preceding embodiment, the at least one guide part may include two guide parts. The two guide parts may be arranged in symmetry relative to a plane containing the driving axis and extending in an extension direction of the grip part. According to this embodiment, the tool body and the handle can move relative to each other more stably, compared to a configuration including only one guide part.

In addition or in the alternative to the preceding embodiments, the at least one guide part may further include an elastic member that elastically connects the first portion and the second portion. This configuration can effectively reduce vibration transmission from the tool body to the handle via the first and second portions.

In addition or in the alternative to the preceding embodiments, a first one of the first and second portions may be configured to hold the elastic member to be movable in the front-rear direction relative to a second one of the first and second portions. According to this embodiment, the relative movement of the first and second portions in the front-rear direction (the relative movement of the tool body and the handle) can be guided, utilizing a simple structure.

In addition or in the alternative to the preceding embodiments, the elastic member may have an annular (ring-like, loop-like) shape. Further, the second one of the first and second portions may include a protrusion (projection) that is fitted into the elastic member. According to this embodiment, the first and second portions that are elastically connected by a simple structure can achieve the relative movement of the first and second portions (the relative movement of the tool body and the handle) in a direction that intersects an axis of the protrusion.

In addition or in the alternative to the preceding embodiments, an inner peripheral (circumferential) surface of the elastic member and an outer peripheral (circumferential) surface of the protrusion may be in a partially non-contact state with each other. To put it differently, a portion of an inner peripheral (circumferential) surface of the elastic member is not in contact with an outer peripheral (circumferential) surface of the protrusion. According to this embodiment, the elastic member can be elastically deformed more easily, compared to a configuration in which an entirety of the inner peripheral surface of the elastic member is substantially in contact with an entirety of the outer peripheral surface of the protrusion.

In addition or in the alternative to the preceding embodiments, the at least one guide part may further include a metal holder that is disposed (interposed) between (i) the elastic member and (ii) the first one of the first and second portions. The metal holder may hold the elastic member. To put it differently, the elastic member may be held by the first one of the first and second portions via the holder. The holder may be slidable in the front-rear direction relative to the first one of the first and second portions. According to this embodiment, owing to the holder, the elastic member can move in the front-rear direction more easily, compared to a configuration in which the elastic member is directly held by either one of the first and second portions. Further, wear of the elastic member can be suppressed.

In addition or in the alternative to the preceding embodiments, the at least one guide part may include (i) at least one front guide part and (ii) at least one rear guide part. The at least one rear guide part may be arranged closer to the grip part than the at least one front guide part in the front-rear direction. According to this embodiment, the at least one front guide part and the at least one rear guide part can stably guide the relative movement of the tool body and the handle in the front-rear direction, at different positions in the front-rear direction.

In addition or in the alternative to the preceding embodiments, elastic deformation property of the elastic member of the at least one front guide part may be different from elastic deformation property of the elastic member of the at least one rear guide part. The elastic deformation property here may be rephrased as elastic deformability, or ease/tendency of elastic deformation. According to this embodiment, by appropriately setting the elastic deformation properties of the elastic members, either of (i) the at least one front guide part and (ii) the at least one rear guide part can be utilized as a fulcrum (pivot) about which the tool body and the handle pivot relative to each other.

In addition or in the alternative to the preceding embodiments, the elastic member of the at least one front guide part may be configured to be less deformable than the elastic member of the at least one rear guide part. According to this embodiment, the tool body and the handle can pivot relative to each other around the at least one front guide part, which is located farther from the grip part than the at least one rear guide part and serves as the fulcrum. Therefore, transmission of vibration in a direction of the relative pivoting movement of the tool body and the handle can be effectively reduced.

In addition or in the alternative to the preceding embodiments, the at least one biasing member may include two biasing members that are disposed on (along) a plane containing the axis of the motor shaft and that are arranged in symmetry relative to the axis of the motor shaft. According to this embodiment, the tool body and the handle can move relative to each other more stably, compared to a configuration including only one biasing member.

Embodiment

A rotary hammer (also called a hammer drill) 1 according to a representative, non-limiting embodiment of the present disclosure is now described in detail with reference to FIGS. 1 to 10. The rotary hammer 1 is an example of an electric tool that is configured to linearly drive the tool accessory 91 by hammering (striking) a tool accessory 91 (i.e., a power tool having a hammer mechanism). More specifically, the rotary hammer 1 is a power tool that is configured to linearly drive the tool accessory 91 along a driving axis A1 (this operation is hereinafter referred to as a hammering operation) and to rotationally drive the tool accessory 91 around the driving axis A1 (this operation is hereinafter referred to as a rotary operation).

As shown in FIG. 1, an outer shell of the rotary hammer 1 is mainly formed by a tool body 2 and a handle 3 that is connected to the tool body 2.

The tool body 2 is a hollow body that houses major mechanisms of the rotary hammer 1. The tool body 2 may also be referred to as a body housing, an outer housing, etc. The tool body 2 extends along the driving axis A1 of the tool accessory 91. A tool holder 79 is disposed in one end portion (a first end portion) of the tool body 2 in an extension direction of the driving axis A1 (hereinafter, simply referred to as a driving-axis direction). The tool accessory 91 is removably held by the tool holder 79. The tool body 2 mainly houses a motor 71 and a driving mechanism 75 that is configured to drive the tool accessory 91 held by the tool holder 79 using power generated by the motor 71. In this embodiment, the motor 71 is arranged such that a rotational axis A2 of a motor shaft 711, which rotates integrally with a rotor, extends in parallel to the driving axis A1.

The handle 3 is formed separately from the tool body 2 and connected to the tool body 2 such that the handle 3 is pivotable relative to the tool body 2 and also movable in the driving-axis direction relative to the tool body 2. The handle 3 has a grip part 33 configured to be gripped by a user. The grip part 33 protrudes from the other end portion (a second end portion) of the tool body 2 in the driving-axis direction (i.e., an end portion opposite to the one end portion in which the tool holder 79 is disposed) and extends in a direction that intersects the driving axis A1 (specifically, a direction that is substantially orthogonal to the driving axis A1 and to the rotational axis A2). A distal end (protruding end) of the grip part 33 is a free end. The grip part 33 has a trigger 331 configured to be manually depressed (pulled) by the user. In the rotary hammer 1, when the motor 71 is energized in response to depressing manipulation of the trigger 331, the driving mechanism 75 is driven for the hammering operation and/or the rotary operation.

The detailed structure of the rotary hammer 1 is now described. For the sake of convenience, in the following description, the extension direction of the driving axis A1 (the longitudinal direction of the tool body 2) is defined as a front-rear direction of the rotary hammer 1. In the front-rear direction, the side on which the tool holder 79 is disposed is defined as a front side of the rotary hammer 1, while the opposite side (the side on which the grip part 33 is located) is defined as a rear side of the rotary hammer 1. A direction that is orthogonal to the driving axis A1 and that generally corresponds to the extension direction of the grip part 33 (a direction that is orthogonal to the driving axis A1 and to the rotational axis A2) is defined as an up-down direction of the rotary hammer 1. In the up-down direction, the side on which the grip part 33 is connected to the tool body 2 is defined as an upper side of the rotary hammer 1, while the side on which the free end of the grip part 33 is located is defined as a lower side of the rotary hammer 1. A direction that is orthogonal to both of the front-rear direction and the up-down direction is defined as a left-right direction of the rotary hammer 1.

First, the structures of the tool body 2 and elements (components) disposed within the tool body 2 are described.

The tool body 2 includes a driving-mechanism housing part 21 and a motor housing part 23.

As shown in FIG. 1, the driving-mechanism housing part 21 is a hollow body that houses the driving mechanism 75. The driving-mechanism housing part 21 forms a front half of the tool body 2. A front portion of the driving-mechanism housing part 21 has a cylindrical shape. The tool holder 79 is disposed within this cylindrical portion. The remaining portion of the driving-mechanism housing part 21 other than its front portion has a generally rectangular tubular shape. The driving mechanism 75 includes a motion converting mechanism and a hammering (striking) mechanism for the hammering operation, and a rotation transmitting mechanism for the rotary operation. The driving mechanism 75 is only briefly described here since the driving mechanism 75 is well-known. The motion converting mechanism typically includes an oscillating member (for example, a swash bearing, a wobble plate/bearing, etc.) or a crank mechanism, and a piston, to convert rotation into linear motion. The rotation transmitting mechanism typically includes a speed reducing mechanism having a train of gears.

In this embodiment, the rotary hammer 1 has three action modes of (i) a hammer mode (hammering only mode), in which the rotary hammer 1 performs only the hammering operation; (ii) a rotary mode (rotation only mode), in which the rotary hammer 1 performs only the rotary operation; and (iii) a rotary hammer mode (hammering with rotation mode), in which the rotary hammer 1 performs the hammering operation and the rotary operation at the same time. Although not shown or described in detail, the driving mechanism 75 is driven in accordance with the action mode selected by the user via a mode changing knob.

Figure 3:
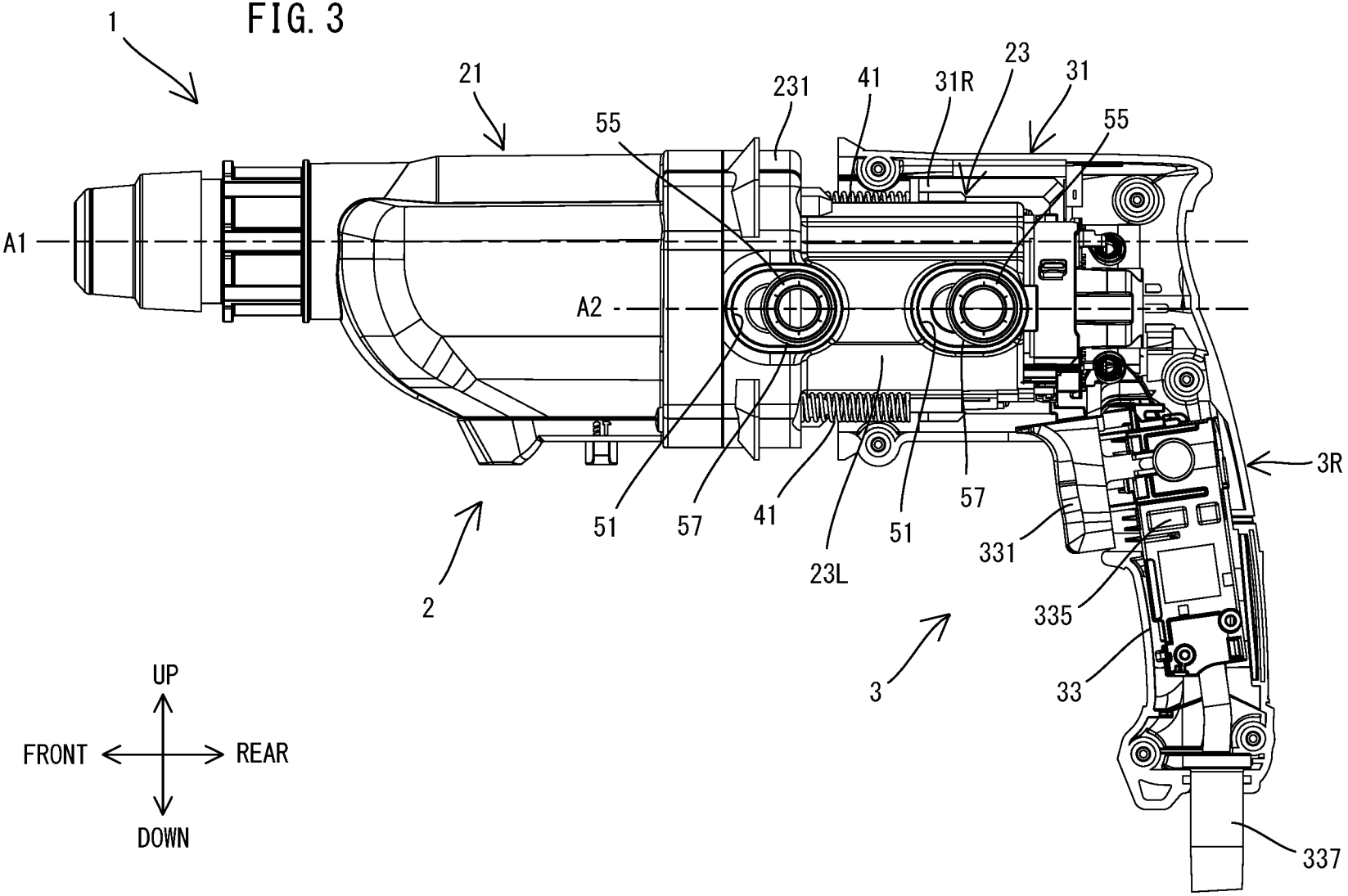
FIG. 3 is a left side view of the rotary hammer in a state in which a left member of the handle is removed and the handle is at the initial position.
Figure 4:
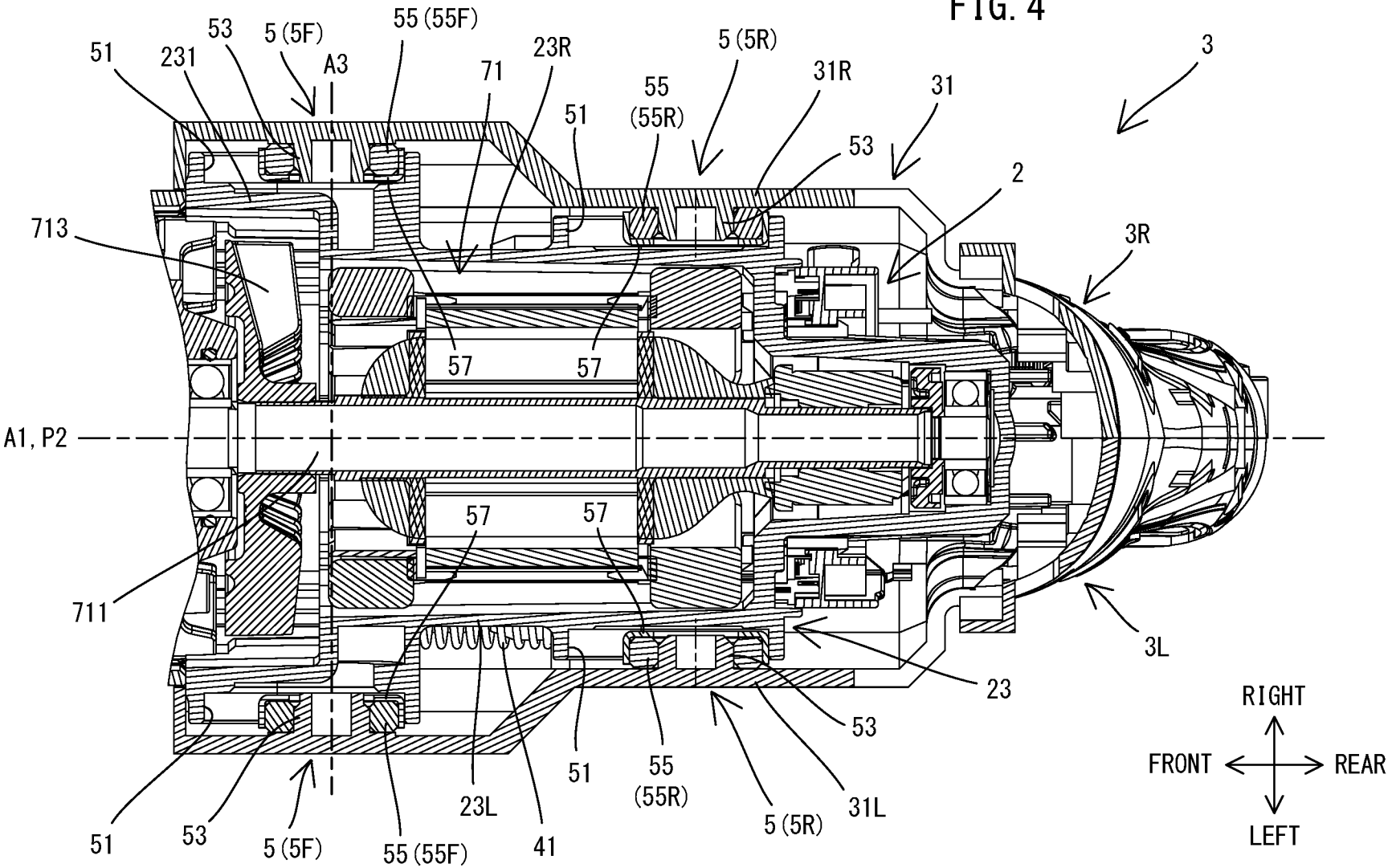
FIG. 4 is a sectional view taken along line IV-IV in FIG. 1.

As shown in FIGS. 1, 3 and 4, the motor housing part 23 is a hollow body that houses the motor 71. The motor housing part 23 has a tubular shape with a closed rear end. In this embodiment, the motor housing part 23 is a single member (without seams) that is formed separately (discretely) from the driving-mechanism housing part 21. The motor housing part 23 is fixedly connected to a rear end of the driving-mechanism housing part 21 using screws (not shown). The motor housing part 23 forms a rear half of the tool body 2.

In this embodiment, the motor 71 is an AC motor that includes a stator, the rotor, the motor shaft 711 and a commutator. The motor shaft 711 extends in the front-rear direction. A portion of the motor shaft 711 extends forward of the stator. A fan 713 is fixed to this portion of the motor shaft 71. The fan 713 is disposed within a front portion 231 of the motor housing part 23. The front portion 231 of the motor housing part 23 protrudes outward in a radial direction of the stator from a portion extending rearward from the front portion 231 (i.e., a portion that houses the stator etc.).

In this embodiment, the motor housing part 23 of the tool body 2 has two first spring receiving part (spring seats) 25 (see FIG. 5) and four guide recesses 51 (see FIG. 4), which serve as a structure for elastically connecting the tool body 2 and the handle 3. The structure for elastically connecting the tool body 2 and the handle 3 will be described in detail later.

The structures of the handle 3 and elements (components) disposed within the handle 3 are now described.

Figure 2:
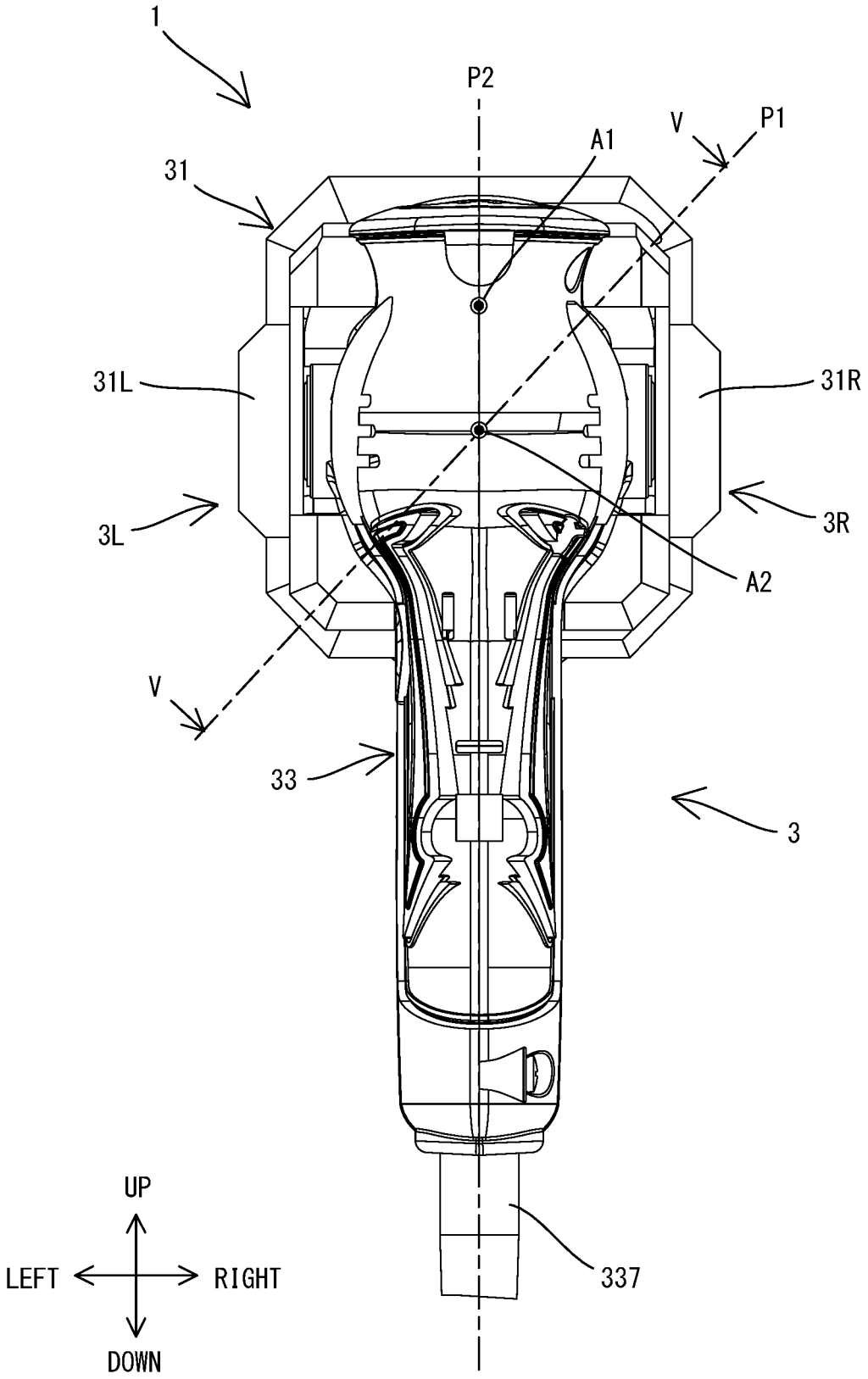
FIG. 2 is a rear view of the rotary hammer.

As shown in FIGS. 2 to 4, the handle 3 of this embodiment is formed by a left member (a left shell or a left handle part) 3L and a right member (a right shell or a right handle part) 3R that are fixedly connected to each other in the left-right direction, using screws (not shown) fixed at multiple positions. The handle 3 includes a cover part 31 and the grip part 33.

As shown in FIGS. 1 to 4, the cover part 31 basically has a tubular shape with a closed rear end. The cover part 31 covers a rear portion of the tool body 2 (specifically, the most part of the motor housing part 23). The cover part 31 includes a left wall part 31L, a right wall part 31R, an upper wall part, a lower wall part and a rear wall part that are respectively arranged leftward of, rightward of, above, below and rearward of the motor housing part 23. A central portion in the up-down direction of each of the left wall part 31L and the right wall part 31R protrudes forward of the remaining portions of each of the left wall part 31L and the right wall part 31R. A portion of the rear portion of the tool body 2 is not covered by the cover part 31. A bellows part 29 covers this portion. The bellows part 29 is configured to extend/contract in the front-rear direction in response to relative movement of the tool body 2 and the handle 3.

In this embodiment, the cover part 31 has two second spring receiving parts (spring seats) 35 (see FIG. 5) and four guide protrusions (projections) 53 (see FIG. 4), which serve as a structure for elastically connecting the tool body 2 and the handle 3. The second spring receiving parts 35 are connected to the first spring receiving parts 25 via biasing members 41, respectively. The guide protrusions 53 are connected to the guide recesses 51 via elastic members 55 and associated holders 57, respectively. The structure for connecting the tool body 2 and the handle 3 will be described in detail later.

As shown in FIG. 3, the grip part 33 has an elongate tubular shape. The grip part 33 extends downward from the cover part 31 in a cantilever manner. Thus, the grip part 33 extends in the up-down direction below a lower end of the tool body 2. The trigger 331 is disposed on an upper portion of the grip part 33. A switch 335 is disposed behind the trigger 331 within the grip part 33. The switch 335 is normally kept OFF and is turned ON in response to depressing manipulation of the trigger 331. When the switch 335 is turned ON, the motor 71 is energized. A power cord 337, which is connectable to an external AC power source, extends from a lower end of the grip part 33 (the free end or the protruding end of the handle 3).

The details of the structure for connecting the tool body 2 and the handle 3 are now described.

First, the details of the structure for connecting the first spring receiving parts 25 and the second spring receiving parts 35 are described.

Figure 5:
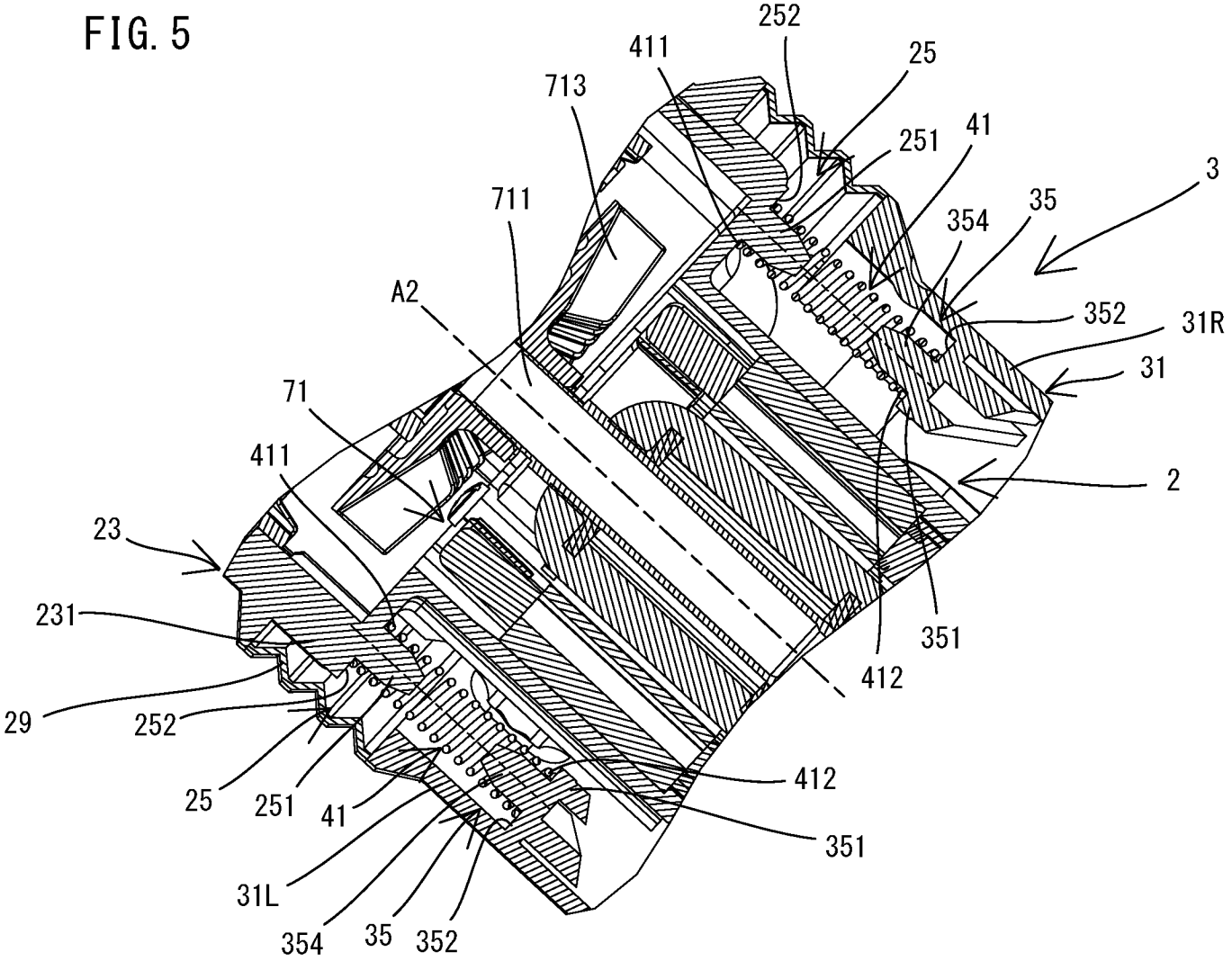
FIG. 5 is a sectional view taken along line V-V in FIG. 2.

As shown in FIG. 5, the front portion 231 of the motor housing part 23 of the tool body 2 has the two first spring receiving parts (the spring seats) 25. More specifically, one of the first spring receiving parts 25 is on a lower left rear portion of the front portion 231. The other one of the first spring receiving parts 25 is on a right upper rear portion of the front portion 231. Further more specifically, the two first spring receiving parts 25 are arranged on (along) an imaginary plane P1 (see FIG. 2) that contains the rotational axis A2 of the motor shaft 711 and extends from a lower left side toward an upper right side when viewed from behind the rotary hammer 1. Thus, the plane P1 intersects the first spring receiving parts 25. The first spring receiving parts 25 are also arranged in symmetry relative to the rotational axis A2. Thus, the two first spring receiving parts 25 are disposed at different positions in the up-down direction and in the left-right direction, but arranged at substantially the same position in the front-rear direction. The first spring receiving parts 25 are substantially at the same distance from the rotational axis A2 of the motor shaft 711.

The biasing member 41 of this embodiment is a compression coil spring having a first end portion 411 and a second end portion 412. Each of the first spring receiving parts 25 is configured to receive (abut on) the first end portion 411 of the biasing member 41. More specifically, each of the first spring receiving parts 25 includes a protrusion 251 that protrudes rearward from a rear end surface of the front portion 231. The first end portion 411 of the biasing member 41 is fitted around the protrusion 251 of the first spring receiving part 25, and abuts on the rear end surface of the front portion 231 (a shoulder portion) of the motor housing part 23. The rear end surface of the front portion 231 thus serves a contact surface 252.

The two second spring receiving part 35 are arranged to correspond to the two first spring receiving part 25 of the tool body 2, respectively. More specifically, one of the second spring receiving parts 35 is disposed on (in) a lower left central portion of the cover part 31 and the other one of the second spring receiving parts 35 is disposed on (in) an upper right central portion of the cover part 31. Further more specifically, the two second spring receiving parts 35 are arranged on (along) the plane P1 (see FIG. 2). Thus, the plane P1 intersects the second spring receiving parts 35. The second spring receiving parts 35 are also arranged in symmetry relative to the rotational axis A2. The two second spring receiving part 35 are arranged directly behind the two first spring receiving part 25, respectively. Thus, a straight line that passes the first spring receiving part 25 and that is parallel to the rotational axis A2 of the motor shaft 711 (i.e., that extends in the front-rear direction) also passes through the second spring receiving part 35.

Each of the second spring receiving parts 35 is configured to receive (abut on) the second end portion 412 of the biasing member 41. More specifically, each of the second spring receiving parts 35 has a base part 351 that protrudes toward an inside of the cover part 31, and a protrusion 354 that protrudes forward from the base part 351. The second end portion 412 of the biasing member 41 is fitted around the protrusion 354, and abuts on a front end surface of the base part 351. The front end surface of the base part 351 thus serves as a contact surface 352.

In this manner, the first spring receiving parts 25 and the corresponding second spring receiving parts 35 are elastically connected to each other by the biasing members 41, respectively. Each of the biasing members 41 is held between the first spring receiving part 25 and the second spring receiving part 35 in a compressed manner, and thus biases the tool body 2 and the handle 3 away from (to be separated from) each other. Specifically, the biasing members 41 each bias the tool body 2 and the handle 3 forward and rearward, respectively.

The structure for connecting the guide recesses 51 and the guide protrusions 53 is now described.

As shown in FIGS. 3 and 4, a left portion 23L of the motor housing part 23 has two of the four guide recesses 51, and a right portion 23R of the motor housing part 23 has the other two of the guide recesses 51. More specifically, the two guide recesses 51 are arranged on the left portion 23L to be spaced apart from each other in the front-rear direction. Similarly, the two guide recesses 51 are arranged on the right portion 23R to be spaced apart from each other in the front-rear direction. The two guide recesses 51 in each of the left portion 23L and the right portion 23R are disposed in a front region and a rear region in the front-rear direction within a portion of the motor housing part 23 that is covered by the cover part 31 of the handle 3. Further, the two guide recesses 51 are arranged at substantially the same position in the up-down direction. Thus, the two guide recesses 51 are aligned on a straight line extending in the front-rear direction in a side view (when the tool body 2 is viewed from the left or right side). To put it differently, a straight line that extends in the front-rear direction passes through (overlaps) the two guide recesses 51 in the side view. In this embodiment, the two guide recesses 51 are located on (overlap) the rotational axis A2 of the motor shaft 711 in the side view.

Further, a front pair of left and right guide recesses 51, among the four guide recesses 51, are arranged in symmetry relative to an imaginary plane P2 (see FIG. 2) that passes the center of the rotary hammer 1 (the tool body 2) in the left-right direction and that extends in the up-down direction (i.e. a substantial extension direction of the grip part 33). The plane P2 is also an imaginary plane that contains the driving axis A1 and that extends in the up-down direction (or an imaginary plane that contains the driving axis A1 and the rotational axis A2). Similarly, a rear pair of left and right guide recesses 51 are arranged in symmetry relative to the plane P2.

The four guide recesses 51 have slightly different shapes to each other, but have the substantially identical configuration. Specifically, each guide recess 51 is a recess (cavity, hollow) having a depth in the left-right direction. Each of the guide recesses 51 is defined by a peripheral wall part that protrudes leftward from the left portion 23L of the motor housing part 23 or by a peripheral wall part that protrudes rightward from the right portion 23R of the motor housing part 23. Each of the guide recesses 51 has a length in the front-rear direction and a width in the up-down direction that is smaller than the length. A front end portion of each guide recess 51 has a semicircular shape in the side view. Similarly, a rear end portion of each guide recess 51 has a semicircular shape in the side view.

As shown in FIG. 4, corresponding to the arrangement of the four guide recesses 51 of the tool body 2, the left wall part 31L of the cover part 31 has two of the four guide protrusions 53, and the right wall part 31R of the cover part 31 has the other two of the four guide protrusions 53. More specifically, the two guide protrusions 53 are arranged on the left wall part 31L of the cover part 31 to be spaced apart from each other in the front-rear direction. Similarly, the two guide protrusions 53 are arranged on the right wall part 31R of the cover part 31 to be spaced apart from each other in the front-rear direction. Further, the two guide protrusions 53 on each of the left wall part 31L and the right wall part 31R are arranged at substantially the same position in the up-down direction. Thus, the two guide protrusions 53 are aligned on a straight line (more specifically, on the rotational axis A2 of the motor shaft 711) extending in the front-rear direction in a side view (when the tool body 2 is viewed from the left or right). To put it differently, a straight line (the rotational axis A2) that extends in the front-rear direction passes through (overlaps) the two protrusions 53 in the side view.

Further, a front pair of left and right guide protrusions 53, among the four guide protrusions 53, are arranged in symmetry relative to the plane P2 (see FIG. 2). Similarly, a rear pair of left and right guide protrusions 53 are arranged in symmetry relative to the plane P2.

The four guide protrusions 53 have slightly different shapes to each other, but have the substantially identical configuration. Specifically, each guide protrusion 53 is a protrusion (projection) having a circular sectional shape. Each of the guide protrusions 53 is a protrusion that protrudes rightward from the left wall part 31L (i.e., toward the left portion 23L of the motor housing part 23) or a protrusion that protrudes leftward from the right wall part 31R (i.e., toward the right portion 23R of the motor housing part 23). The outer diameter of each of the guide protrusions 53 is smaller than the width of the guide recess 51 in the up-down direction. Further, the length of each of the guide protrusions 53 is set such that a protruding end (tip end) of the guide protrusion 53 does not contact an outer surface of the motor housing part 23 (i.e., a bottom surface of the guide recess 51).

As shown in FIG. 4, in this embodiment, each of the guide protrusions 53 is connected to the corresponding guide recess 51 via the elastic member 55 and the holder 57 such that the guide protrusion 53 is movable in the front-rear direction relative to the guide recess 51. The guide recess 51, the guide protrusion 53, the elastic member 55 and the holder 57 form a guide part 5 that guides relative movement of the tool body 2 and the handle 3 in the front-rear direction. In this embodiment, the rotary hammer 1 includes a total of four such guide parts 5. Specifically, the left side portion of the rotary hammer 1 has two of the four guide parts 5, while the right side portion of the rotary hammer 1 has the other two guide parts 5. In the following description, the four guide parts 5 may be simply collectively referred to the guide parts 5 when they are mentioned without distinction. Similarly, any one of the four guide parts 5 may be simply referred to as the guide part 5 when it is mentioned without distinction. Among the four guide parts 5, either one of the front pair of left and right guide parts 5 may be referred to as a front guide part 5F, and either one of the rear pair of left and right guide parts 5 may be referred to as a rear guide part 5R.

Figure 6:
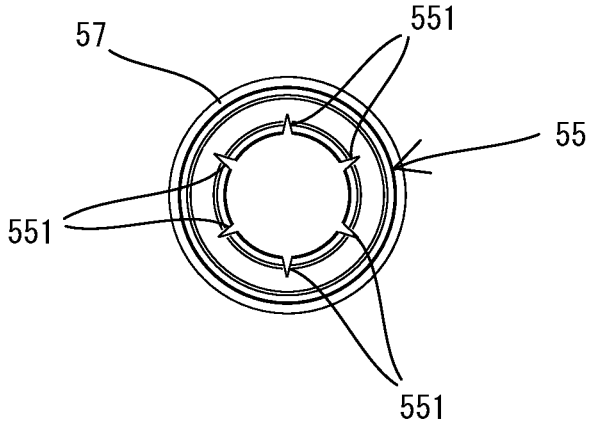
FIG. 6 is a side view of an elastic member fitted into a holder.
Figure 7:
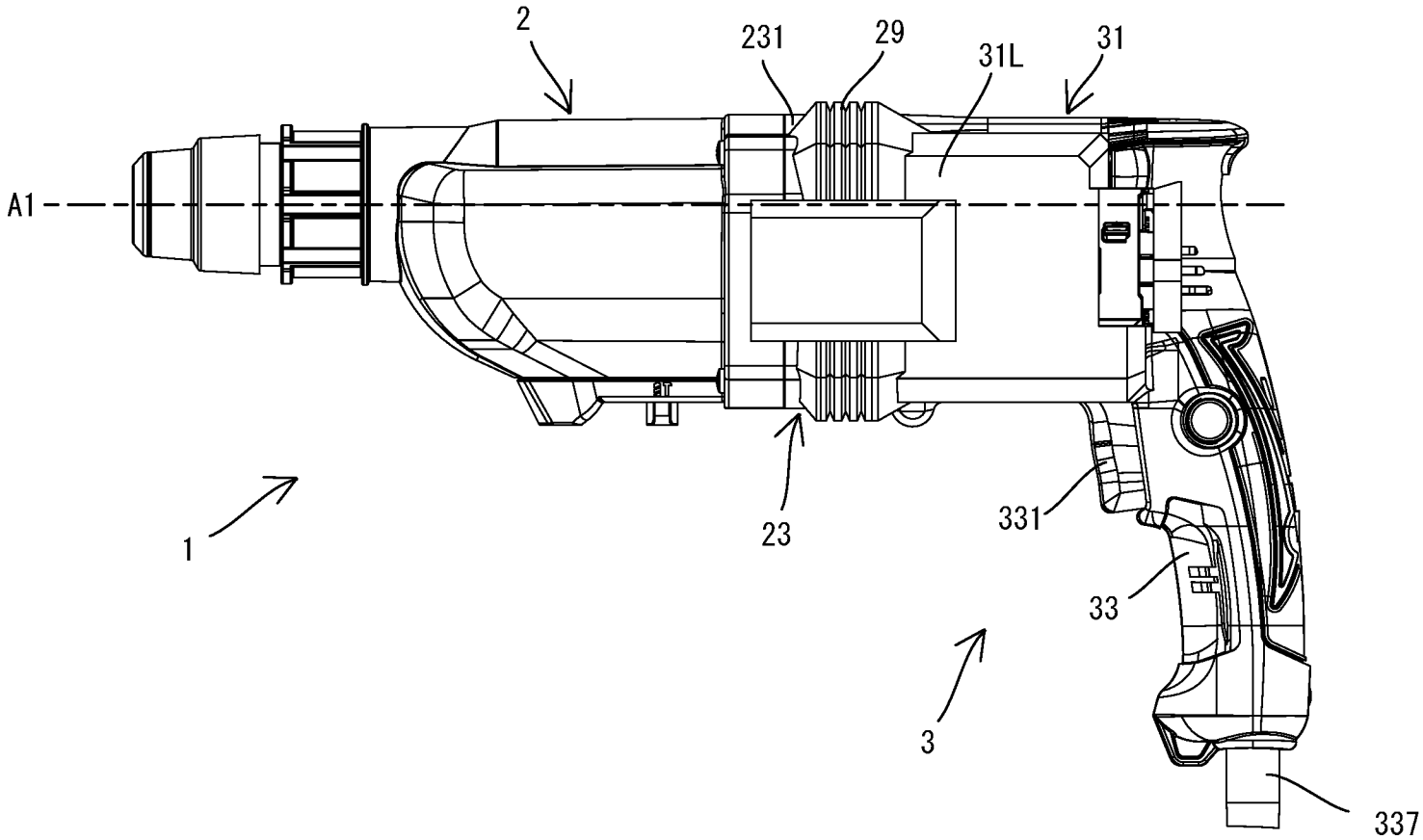
FIG. 7 is a left side view of the rotary hammer in a state in which the handle is at (in) a forward position.
Figure 8:
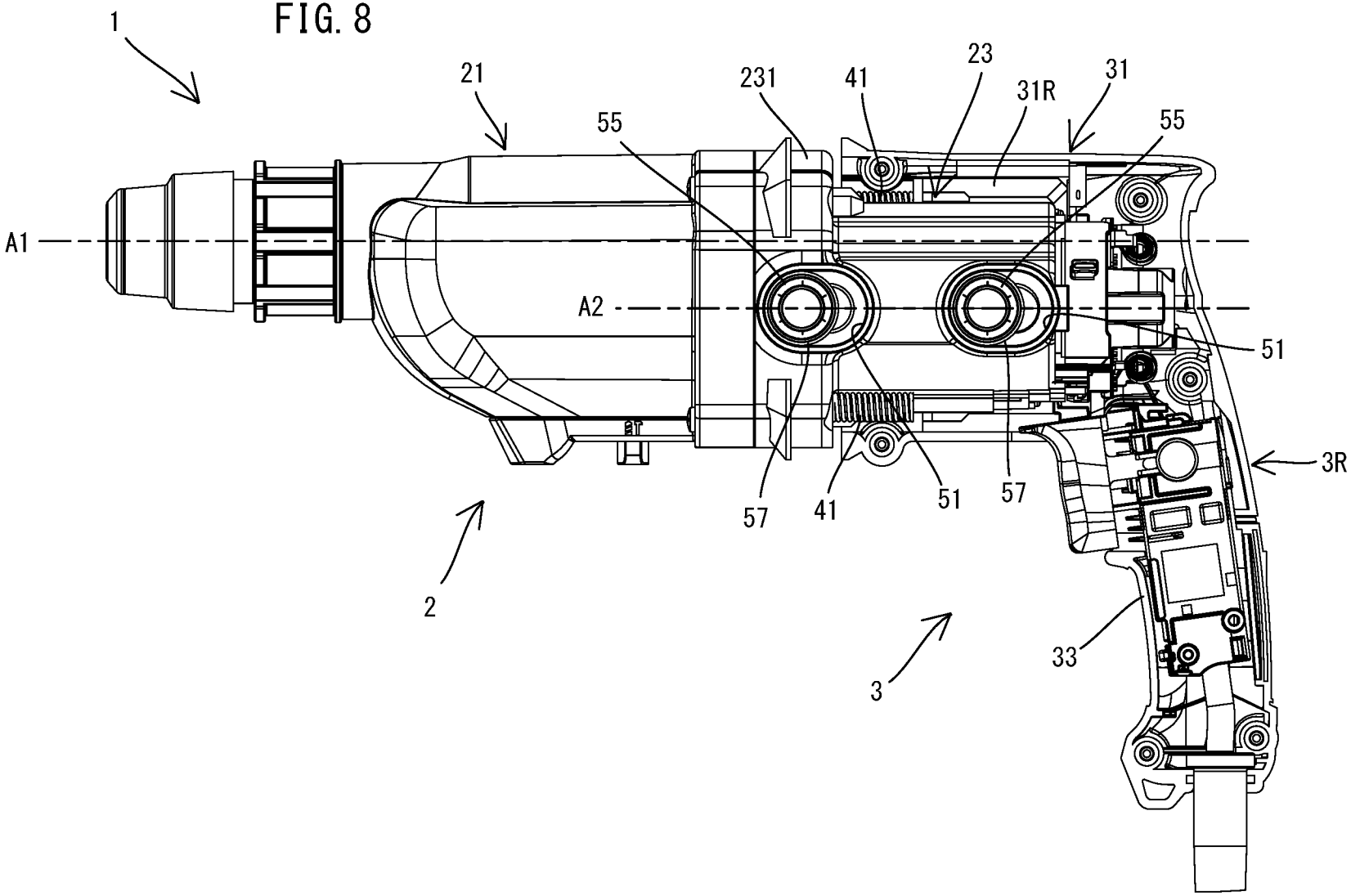
FIG. 8 is a left side view of the rotary hammer in a state in which the left member of the handle is removed and the handle is at the forward position.
Figure 9:
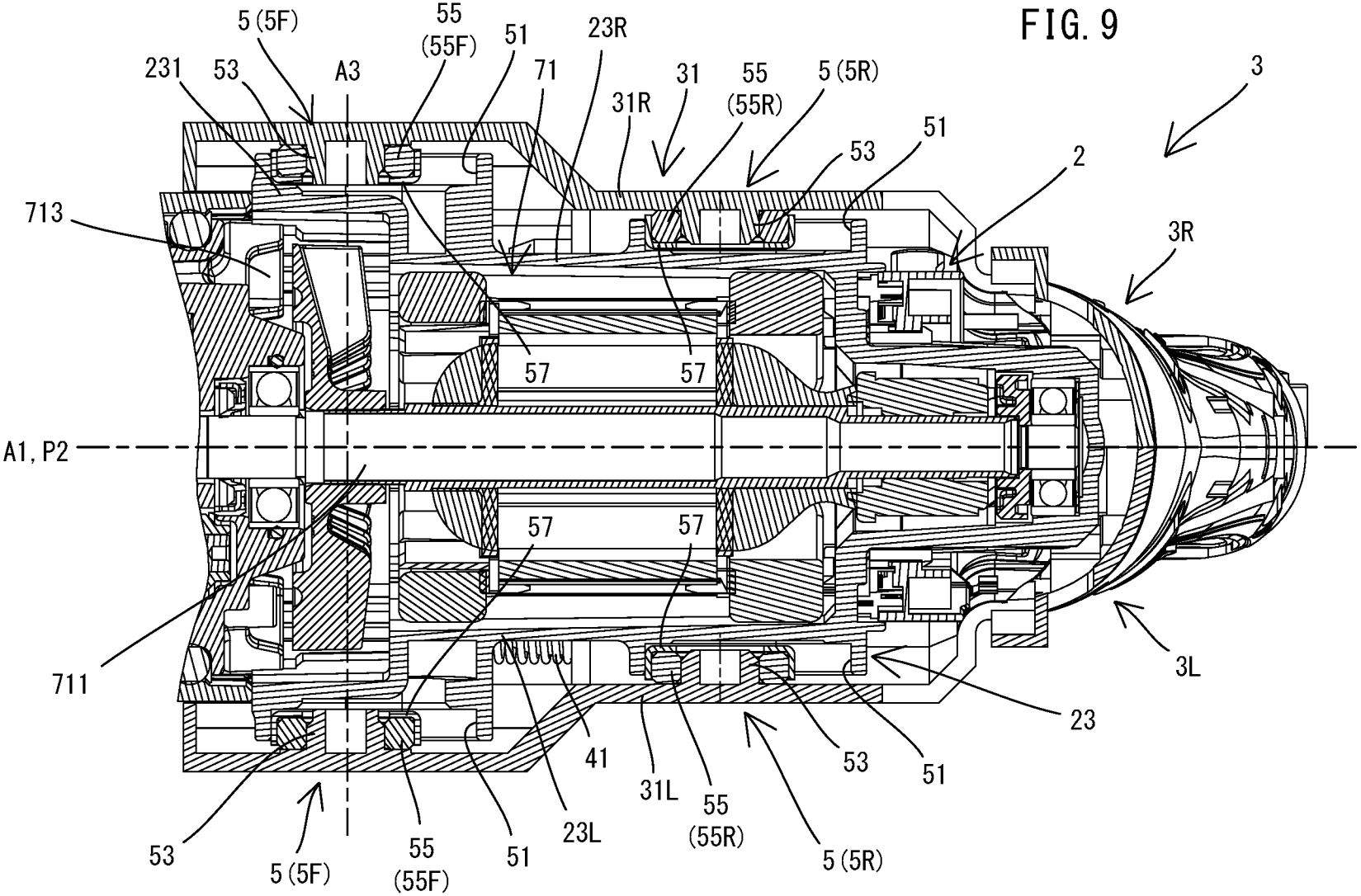
FIG. 9 is a sectional view corresponding to FIG. 4 that shows a state in which the handle is at the forward position.
Figure 10:
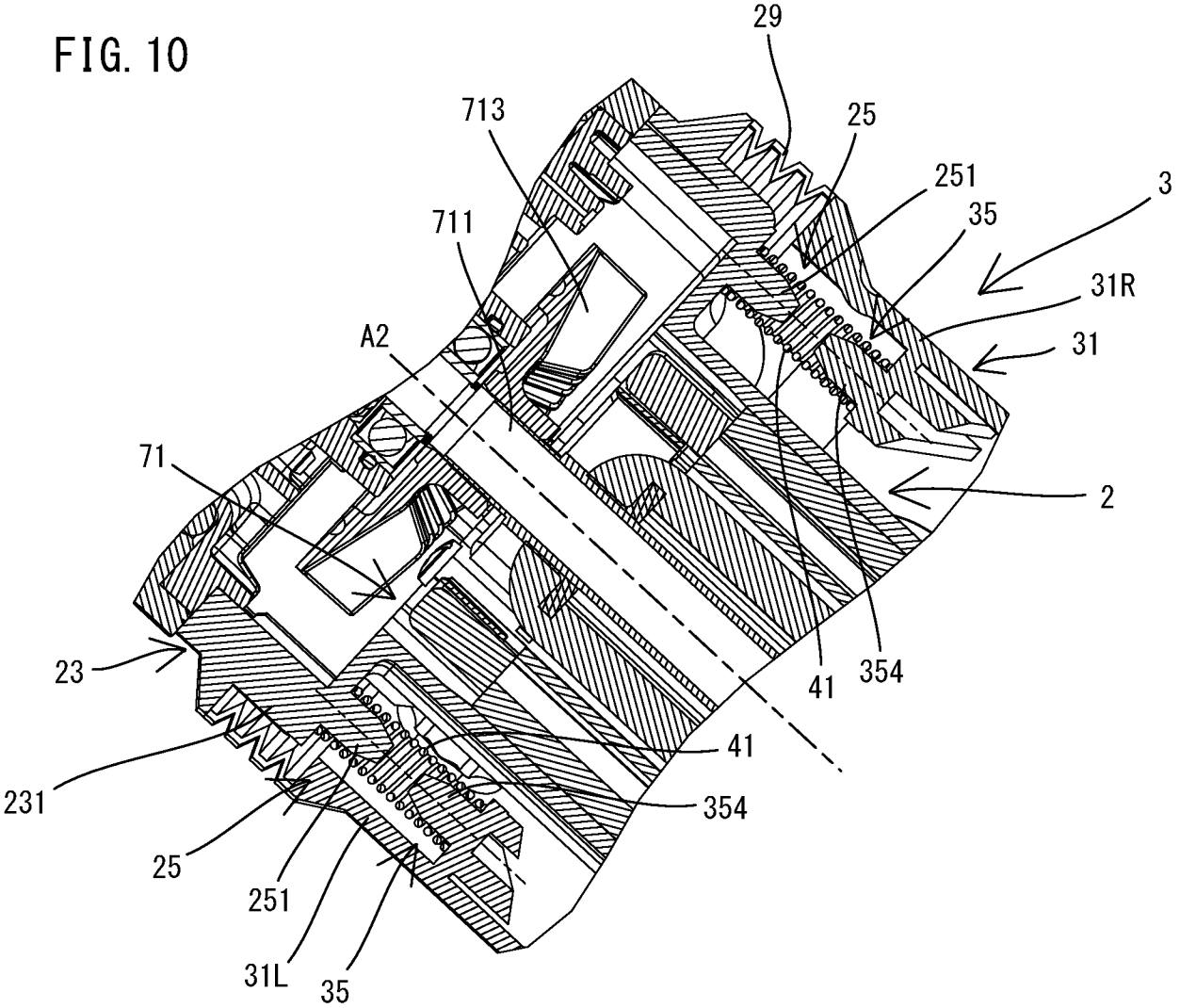
FIG. 10 is a sectional view corresponding to FIG. 5 that shows a state in which the handle is at the forward position.

As shown in FIGS. 3, 4 and 6, the elastic member 55 has an annular (circular, ring-like) shape (or a short cylindrical shape). In other words, the elastic member 55 is an elastic ring. In this embodiment, all the four elastic members 55 have substantially the same shape (an inner diameter, an outer diameter and a thickness). Notches 551 are formed on(in) an inner peripheral surface of each elastic member 55. The notches 551 are equally spaced from each other in a circumferential direction of the elastic member 55. Each notch 551 has a V-shaped section. In the following description, the four elastic members 55 may be simply collectively referred to as the elastic members 55 when they are mentioned without distinction. Any one of the elastic members 55 may be simply referred to as the elastic member 55 when it is mentioned without distinction. Among the four elastic members 55, the elastic member 55 of either one of the front guide parts 5F may be referred to as a front elastic member 55F, and the elastic member 55 of either one of the rear guide parts 5R may be referred to as a rear elastic member 55R.

In this embodiment, all the four elastic members 55 are made of silicone rubber. However, elastic deformation property (elastic deformability, or ease/tendency of elastic deformation) of the front elastic members 55F is different from elastic deformation property of the rear elastic members 55R. More specifically, the front elastic members 55F are less elastically deformable (more difficult to be elastically deformed), compared to the rear elastic members 55R. Specifically, the front elastic members 55F are each made of silicone rubber having higher hardness (i.e. harder) than that of silicone rubber of a rear elastic member 55R.

As shown in FIGS. 3 and 4, the holder 57 is configured to be slidable in the front-rear direction within the guide recess 51 of the tool body 2. More specifically, the holder 57 includes a bottom wall part and a peripheral wall part. The bottom wall part has a disc-like shape and has a through hole formed at its center. The peripheral wall part surrounds an outer edge of the bottom wall part. The outer diameter of the peripheral wall part is generally equal to the width of the guide recess 51 in the up-down direction and is shorter than the length of the guide recess 51 in the front-rear direction. The holder 57 is slidable in the front-rear direction within the guide recess 51 while the bottom wall part is at least partially in contact with the bottom surface of the guide recess 51 and the peripheral wall part is partially in contact with the surfaces that define the upper end and the lower end of the guide recess 51. The holder 57 is configured to fit in the semicircular front end portion and in the semicircular rear end portion of the guide recess 51. Further, the holder 57 is pivotable (rotatable) within the guide recess 51 around an axis extending in the left-right direction. On the other hand, upward/downward movement of the holder 57 within the guide recess 51 is restricted. The holder 57 of this embodiment is made of metal (for example, iron or iron alloy).

The elastic member 55 is fitted into and held by the holder 57. A portion of the elastic member 55 normally protrudes outward from the protruding end of the peripheral wall part of the holder 57. Further, the guide protrusion 53 of the handle 3 is fitted inside the elastic member 55. As described above, the notches 551 are formed on the inner peripheral surface of the elastic member 55. Therefore, the inner peripheral surface of the elastic member 55 and the outer peripheral surface of the guide protrusion 53 are not completely (entirely) in contact with each other (in a partially non-contact state). Thus, compared to a structure in which the inner peripheral surface of the elastic member 55 and the outer peripheral surface of the guide protrusion 53 are substantially entirely in contact with each other, the elastic member 55 can be elastically deformed more easily in a direction that intersects the axis of the guide protrusion 53 (e.g., in the radial direction of the guide protrusion 53).

The portion of the elastic member 55 that protrudes outward from the protruding end of the peripheral wall part of the holder 57 abuts on an inner surface of the left wall part 31L or on the right wall part 31R of the handle 3 (the cover part 31), around a proximal end (base end) of the guide protrusion 53. The tip end of the guide protrusion 53 is within the through hole of the bottom wall part of the holder 57, and is spaced apart from the bottom surface of the guide recess 51 (i.e., the outer surface of the motor housing part 23).

Owing to the above-described connecting structure, in each of the guide parts 5, the elastic member 55 is held between the peripheral wall part of the holder 57 and the guide protrusion 53 while slightly compressed in the radial direction. Further, the elastic member 55 is held between the bottom wall part of the holder 57 and the right wall part 31L or between the bottom wall part of the holder 57 and the left wall part 31R while slightly compressed in the left-right direction. In this manner, in each of the four guide parts 5, the guide recess 51 and the guide protrusion 53 are elastically connected via the holder 57 and the elastic member 55. The elastic members 55 thus maintain (hold) the handle 3 to be spaced apart from tool body 2 and the holder 57.

As described above, the biasing members 41 bias the tool body 2 and the handle 3 away from each other in the front-rear direction (i.e., forward and rearward, respectively). Therefore, in an initial state, owing to the biasing force of the biasing members 41, the handle 3 is held at (in) a position (a position shown in FIGS. 3 and 4, hereinafter referred to as an initial position) where the holder 57 abuts (fits in) the rear end portion of the corresponding guide recess 51 in each of the guide parts 5.

When an external force that causes the tool body 2 and the handle 3 to move closer to each other (for example, a pressing force of the user upon pressing the tool accessory 91 against a workpiece) is applied in the front-rear direction, as shown in FIGS. 7 to 10, the handle 3 moves forward relative to the tool body 2 from the initial position while compressing the biasing members 41 (against the biasing force of the biasing members 41). In response to this relative movement, the holders 57, which are respectively connected to the guide protrusions 53 of the handle 3 via the elastic members 55, slide forward along the corresponding guide recesses 51. During this sliding movement, the elastic members 55 are not substantially compressively deformed (compressed) from the initial state. The handle 3 moves forward relative to the tool body 2 against the biasing force of the biasing members 41 to a position (a position shown in FIGS. 8 and 9, hereinafter referred to as a forward position) where the holder 57 abuts (fits in) the front end portion of the guide recess 51.

When the handle 3 moves further forward from the forward position, in each guide part 5, a portion of the elastic member 55 between the front end portion of the guide protrusion 53 and the front end portion of the guide recess 51 (the peripheral wall part of the holder 57) is elastically deformed (compressively deformed, compressed). The handle 3 is movable relative to the tool body 2 to a foremost position, which is further forward of the forward position, in response to the elastic deformation of the elastic members 55.

When the external force that causes the tool body 2 and the handle 3 to move closer to each other is cancelled (released), the handle 3 is biased by the biasing members 41 and thus returned to the initial position relative to the tool body 2. In response to this relative movement, in each guide part 5, a portion of the elastic member 55 between the rear end portion of the guide protrusion 53 and the rear end portion of the guide recess 51 (the peripheral wall part of the holder 57) can cushion the impact that is caused when the holder 57 comes into contact with the surface that defines the rear end portion of the guide recess 51.

Further, when the tool body 2 and the handle 3 move relative to each other leftward or rightward, the elastic members 55 are compressed and elastically deformed between the left portion 23L of the motor housing part 23 (the bottom wall parts of the corresponding holders 57) and the left wall part 31L of the cover part 31, or between the right portion 23R of the motor housing part 23 (the bottom wall parts of the corresponding holders 57) and the right wall part 31R of the cover part 31.

Further, when the tool body 2 and the handle 3 relatively move in the up-down direction, a portion of the elastic member 55 between the upper end portion of the guide protrusion 53 and the upper end portion of the guide recess 51 (the peripheral wall part of the holder 57) or between the lower end portion of the guide protrusion 53 and the lower end portion of the guide recess 51 (the peripheral wall part of the holder 57) is elastically deformed (compressively deformed, compressed). In this embodiment, the handle 3 can substantially pivot relative to the tool body 2 in response to this relative movement, about the left and right front guide parts 5F (specifically, the guide protrusions 53), which serve as a fulcrum (a pivot shaft).

More specifically, as described above, the front elastic members 55F of the front guide parts 5F are harder and thus can be elastically deformed less easily, compared to the rear elastic members 55R of the rear guide parts 5R. In other words, the rear elastic members 55R can be elastically deformed more easily, compared to the front elastic members 55F. Accordingly, when an external force is applied to cause relative movement of the tool body 2 and the handle 3 in the up-down direction, the handle 3 can substantially pivot relative to the tool body 2 about the guide protrusions 53 (i.e., the fulcrum) of the left and right front guide parts 5F (around a rotational axis A3 that generally coincides with the axes of the guide protrusions 53) while elastically deforming the rear elastic members 55R by a larger amount. This action is also caused when an external force is applied to cause relative pivoting movement of the tool body 2 and the handle 3 around an axis extending in the left-right direction.

Although less easily deformable than the rear elastic members 55R, the front elastic members 55F are still elastically deformable. Thus, in each of the front guide parts 5F, the guide protrusion 53 is movable in a direction (e.g., the front-rear direction or the up-down direction) that intersects the axis of the guide protrusion 53 relative to the holder 57 and the guide recess 51 (i.e., relative to the tool body 2) in response to the elastic deformation of the front elastic member 55F. Thus, the rotational axis A3 of the handle 3 relative to the tool body 2 is changeable in response to the elastic deformation of the elastic members 55.

The actions of the tool body 2 and the handle 3 during the hammering operation are now described.

When the driving mechanism 75 performs the hammering operation, the tool accessory 91 is driven along the driving axis A1. Consequently, largest vibration is generated on the tool body 2 in the driving-axis direction (i.e., in the front-rear direction). In response to the vibration, in each of the guide parts 5, the holder 57 connected to the guide protrusion 53 via the elastic member 55 slides in the front-rear direction within the guide recess 51. Also, the guide protrusion 53 is movable in the front-rear direction within the holder 57 owing to the elastic deformation of the elastic member 55. Thus, the handle 3 can move in the front-rear direction within the range between the initial position and the foremost position relative to the tool body 2. At this time, the biasing members 41 extend/contact in response to the relative movement of the tool body 2 and the handle 3, so that vibration transmission to the handle 3 is reduced. Further, when the handle 3 moves between the forward position and the foremost position, the vibration transmission to the handle 3 is effectively reduced by not only the extension/contraction of the biasing members 41 but also the elastic deformation of the elastic members 55. In this manner, in this embodiment, the vibration transmission can be reduced in accordance with the magnitude of the vibration in the front-rear direction, utilizing the extension/contraction of the biasing members 41, the movement of the elastic members 55 and the elastic deformation of the elastic members 55.

In this embodiment, the rotary hammer 1 includes two pairs of the guide parts 5 (one pair of the front guide parts 5F and one pair of the rear guide parts 5R) that are spaced apart from each other in the front-rear direction. Therefore, the relative movement of the tool body 2 and the handle 3 in the front-rear direction can be stably guided.

Further, the rotary hammer 1 utilizes such a simple structure as the holder 57 that is slidable within the guide recess 51, the relative movement of the guide recess 51 and the guide protrusion 53 in the front-rear direction (the relative movement of the tool body 2 and the handle 3) can be stably guided. Further, since the holder 57 is made of metal, the holder 57 can slide smoothly within the guide recess 51 defined on the motor housing part 23 made of synthetic resin (plastic, polymeric material). Further, the configuration of this embodiment can suppress wear of the elastic member 55, compared to a structure in which the elastic member 55, which is connected to the guide protrusion 53, slides directly along the guide recess 51.

In this embodiment, the tool body 2 and the handle 3 are biased by two biasing members 41. Thus, the tool body 2 and the handle 3 can move relative to each other more stably, compared to a structure having only one spring (biasing member). In particular, the two biasing members 41 are arranged in symmetry relative to the rotational axis A2 of the motor shaft 711 and arranged at different positions in the up-down direction and in the left-right direction. This arrangement of the biasing members 41 can suppress unfavorable tilting of the handle 3 in the up-down direction or in the left-right direction during the relative movement of the handle 3 and the tool body 2 in the front-rear direction.

Further, in this embodiment, the handle 3 is pivotable relative to the tool body 2 about the pair of front guide parts 5F (the guide protrusions 53 (the holders 57)), which serve as the fulcrum (pivot shaft). Thus, the transmission of the vibration in a direction of the relative pivoting movement of the tool body 2 and the handle 3 can be also effectively reduced. In this embodiment, owing to the setting of the elastic deformation properties of the elastic members 55 as described above, the front guide parts 5F serve as the fulcrum of the relative pivoting movement of the tool body 2 and the handle 3. The front guide parts 5F are located farther from the grip part 33 than the rear guide parts 5R. In this embodiment, the guide recesses 51 and the guide protrusions 53 of the front guide parts 5F are disposed at the foremost positions on/in overlapping portions of the motor housing part 23 and the cover part 31, respectively. This arrangement can effectively reduce transmission, to the grip part 33, of the vibration in the direction of the relative pivoting movement of the tool body 2 and the handle 3.

Further, in this embodiment, in each guide part 5, the guide recess 51 and the guide protrusion 53 are connected via the elastic member 55. This configuration can effectively reduce vibration transmission from the tool body 2 to the handle 3 via the guide recess 51 and the guide protrusion 53, compared to a structure in which the guide recess 51 and the guide protrusion 53 are connected directly (to abut on each other).

Further, the annular elastic member 55 fitted around the guide protrusion 53 also allows (permits) the relative movement of the tool body 2 and the handle 3 in the direction intersecting the axis of the guide protrusion 53 and the extension direction of the axis of the guide protrusion 53 (the left-right direction), owing to the elastic deformation. Further, although not as significant as the vibration in the front-rear direction, vibration is also caused on the tool body 2 in the other direction(s) (for example, in the up-down direction and/or in the left-right direction). The connecting structure using the elastic members 55 in this embodiment can also appropriately cope with the vibration in all directions other than the front-rear direction, utilizing the elastic deformation of the elastic members 55.

Correspondences between the features of the above-described embodiment and the features of the present disclosure are as follows. It is noted, however, that the features of the embodiment are merely exemplary, and do not limit the features of the present disclosure or the present invention.

The rotary hammer 1 is an example of the "power tool having a hammer mechanism". The driving axis A1 is an example of the "driving axis". The tool accessory 91 is an example of the "tool accessory". The tool body 2 is an example of the "tool body". The motor 71 is an example of the "motor". The motor shaft 711 is an example of the "motor shaft". The rotational axis A2 is an example of the "axis of the motor shaft". The handle 3 is an example of the "handle". The cover part 31 is an example of the "cover part". The grip part 33 is an example of the "grip part". The biasing member 41 is an example of the "biasing member". The guide part 5 is an example of the "guide part". The guide recess 51 is an example of the "first portion". The guide protrusion 53 is an example of the "second portion".

The elastic member 55 is an example of the "elastic member". The guide recess 51 is an example of the "first one of the first and second portions". The guide protrusion 53 is an example of the "second one of the first and second portions". The guide protrusion 53 is also an example of the "protrusion". The holder 57 is an example of the "holder". The front guide part 5F is an example of the "front guide part". The rear guide part 5R is an example of the "rear guide part". The front elastic member 55F is an example of the "elastic member of the front guide part". The rear elastic member 55R is an example of the "elastic member of the rear guide part". The plane P1 is an example of the "plane containing the axis of the motor shaft".

<Modifications>

The above-described embodiment is merely an exemplary embodiment of the disclosure, and the power tool having the hammer mechanism according to the present disclosure is not limited to the rotary hammer 1 of the above-described embodiment. For example, the following non-limiting modifications may be made. Further, at least one of these modifications may be employed in combination with at least one of the rotary hammer 1 of the above-described embodiment and the claimed features.

In the above-described embodiment, the rotary hammer 1 is exemplarily described as a power tool having a hammer mechanism. However, the feature(s) of the present disclosure may be applied to other power tools that are capable of performing the hammering operation (for example, an electric hammer that performs only the hammering operation without performing the rotary operation). Further, the rotary hammer 1 may have only two action modes of (i) the hammer mode and (ii) the rotary mode. The structures and arrangements of the motor 71 and the driving mechanism 75 may be appropriately changed, depending on the power tool to which the features of the present disclosure are applied. For example, a DC motor (for example, a brushless DC motor) may be employed as the motor 71. In such a modification, for example, a battery mount, which is configured to removably receive a rechargeable battery (a battery pack), may be provided on (in) the tool body 2 or the handle 3.

The structure for connecting the tool body 2 and the handle 3 may be appropriately changed. The modifications relating to the structure for connecting the tool body 2 and the handle 3 are now described.

For example, a biasing member that biases the tool body 2 and the handle 3 away from each other in the front-rear direction is not limited to the biasing member 41. For example, a spring (for example, a tension coil spring, a flat spring, a torsion spring, etc.) other than the compression coil spring may be employed. Alternatively, an elastic member such as rubber or synthetic resin (polymeric material) other than a spring may be employed. The number and positions of the biasing members 41 are not limited to those in the above-described embodiment. For example, only one biasing member 41 may be disposed on (along) the plane P2. Or alternatively, three or more biasing members 41 may be employed. Further, the structures of the first spring receiving part 25 and the second spring receiving part 35 that receive the ends of the biasing member 41 may be appropriately changed in response to the kind, position or the like of the biasing member to be employed.

The structure for guiding the relative movement of the tool body 2 and the handle 3 in the front-rear direction is not limited to the guide part 5. For example, the shapes of the guide recess 51 and the guide protrusion 53 may be appropriately changed. For example, the guide recess 51 may be an opening (a through hole) that penetrates a wall part of the motor housing part 23, instead of a bottomed recess. Further, unlike the guide part 5, the cover part 31 of the handle 3 may have a recess or a through hole extending in the front-rear direction and the portion of the tool body 2 covered by the cover part 31 has a protrusion. In this modification, the protrusion of the tool body 2 may be movable in at least the front-rear direction along the recess or the through hole of the cover part 31.

The kind, shape, number, position or the like of the elastic member(s) 55 are not limited to those in the above-described embodiment. For example, the elastic member 55 may be formed of different kind of rubber from the silicone rubber, or elastically deformable synthetic resin (plastic, polymeric material) (for example, a polymeric foam). Further, instead of the annular elastic member 55, an elastic member having other shape may be employed. Alternatively, multiple elastic members may be disposed between the outer peripheral surface of the guide protrusion 53 and the peripheral wall part of the holder 57. The shape of the holder 57 may be changed according to the modification of the elastic member 55 and/or the guide recess 51. Further, the material of the holder 57 is not limited to metal. For example, the holder 57 may be made of different kind of synthetic resin (plastic, polymeric material) from the tool body 2.

Further, the holder 57 may be omitted and the elastic member 55 may be directly held by the guide recess 51 so as to be slidable in the front-rear direction. In this modification, it is preferable that a coating is applied at least on a sliding surface of the elastic member 55 that slides along the guide recess 51 in order to facilitate the sliding and to suppress the wear. Alternatively, an elastic member that has an opening extending linearly in the front-rear direction may be fitted into the guide recess 51. In this modification, the guide protrusion 53 may be slidable within the opening of the elastic member in the front-rear direction.

The elastic deformation property (elastic deformability, or ease/tendency of elastic deformation) of the front elastic member 55F of the front guide part 5F and the elastic deformation property of the rear elastic member 55R of the rear guide part 5R may be made different from each other by a difference of their materials or of their shapes. For example, the front elastic member 55F and the rear elastic member 55R may be made of rubber or synthetic resin having different elastic modulus and may have the same shape. Alternatively, the front elastic member 55F and the rear elastic member 55R may be made of the same rubber or synthetic resin and may have the same inner diameter and the same outer diameter, and the notches 551 may be formed only on the rear elastic member 55R. In order to set the inner peripheral surface of the elastic member 55 and the outer peripheral surface of the guide protrusion 53 in a partially non-contact state, for example, multiple protrusions (projections) may protrude radially outward from the outer peripheral surface of the guide protrusion 53.

The arrangement of the guide parts 5 is not limited to that in the above-described embodiment. For example, in the above-described embodiment, the two guide parts 5 provided to each of the left portion and the right portion of the rotary hammer 1 are aligned on the straight line extending in the front-rear direction (i.e., located at the same position in the up-down direction). Instead, the two guide parts 5 may be arranged at different positions in the up-down direction. Further, the two guide parts 5 may be arranged on a straight line extending in the front-rear direction below or above the rotational axis A2 of the motor shaft 711 in the side view. The positions of the two guide parts 5 may be appropriately changed within a region where the tool body 2 (the motor housing part 23) and the handle 3 (the cover part 31) overlap with each other. However, it is still preferable that the two guide parts 5 are spaced apart from each other as much as possible in the front-rear direction within the region.

The number of the guide parts 5 is not limited to the above-described example (four), and it is sufficient that the rotary hammer 1 has at least one guide part 5. For example, the rotary hammer 1 may have only one pair of left and right guide parts 5 (for example, the pair of front guide parts 5F). In a modification in which the rotary hammer 1 includes one pair of left and right guide parts 5, the handle 3 may be pivotable relative to the tool body 2 at each guide part 5, in response to pivoting movement of the holder 57, which pivots together with the elastic member 55 and the guide protrusion 53, within the guide recess 51. Alternatively, the rotary hammer 1 may include only two guide parts 5 that are spaced apart from each other in the front-rear direction (for example, the two guide parts 5 on (in) the left portion).

In the above-described embodiment, the handle 3 is formed by two halves (the left member 3L and the right member 3R) connected to each other in the left-right direction. However, the handle 3 may be formed by connecting to halves that are divided, for example, in the front-rear direction. Alternatively, the handle 3 may be formed by connecting a plurality of components divided in other direction. Similarly, the components of the tool body 2 and the connecting structure thereof may be appropriately changed.

Further, in view of the nature of the present disclosure, the following Aspects can be provided. At least one of the following Aspects can be employed in combination with at least one of the above-described embodiment, the above-described modifications and the claimed features.

(Aspect 1)

The second portion is connected to the first portion to be pivotable relative to the first portion.

According to this Aspect, the first and second portions have a function as a fulcrum (pivot) of the relative pivoting movement of the tool body and the handle, in addition to the function of guiding the relative movement of the tool body and the handle in the front-rear direction, and thus the first and second portions can be utilized efficiently.

(Aspect 2)

The tool body and the handle are pivotable relative to each other (i) around the first portions of the two guide parts serving as a fulcrum, or (ii) around the second portions of the two guide parts serving as a fulcrum.

(Aspect 3)

The tool body and the handle are pivotable relative to each other (i) around an axis passing the first portions of the two guide parts, or (ii) around an axis passing the second portions of the two guide parts.

The rotational axis A3 is an example of the "axis passing the second portions of the two guide parts" in this Aspect.

(Aspect 4)

The second one of the first and second portions is configured to move integrally with the elastic member relative to the first one of the first and second portions.

(Aspect 5)

In the power tool as defined in Aspect 4, the elastic member is configured to move in the front-rear direction relative to the first one of the first and second portions when the handle moves relative to the tool body in the front-rear direction within a specified range, and the elastic member is configured to be elastically deformed in response to the movement of the handle relative to the tool body beyond the specified range.

(Aspect 6)

The first one of the first and second portions is a recess or a through hole that extends in the front-rear direction, and the second one of the first and second portions is a protrusion (projection) that protrudes into the recess or the through hole.

The guide recess 51 is an example of the "recess" in this Aspect. The guide protrusion 53 is an example of the "protrusion" in this Aspect.

(Aspect 7)

The first one of the first and second portions is longer in the front-rear direction than the second one of the first and second portions.

(Aspect 8)

The first one of the first and second portions is longer in the front-rear direction than the elastic member.

(Aspect 9)

The holder is pivotable relative to the first one of the first and second portions, around an axis extending in a direction orthogonal to the driving axis.

(Aspect 10)

The at least one front guide part includes a pair of guide parts arranged in symmetry relative to a plane that contains the driving axis and that extends in an extension direction of the grip part, and the at least one rear guide part includes a pair of guide parts arranged in symmetry relative to the plane.

The pair of front guide parts 5F is an example of the "pair of guide parts" of the "at least one front guide part". The pair of rear guide parts 5R is an example of the "pair of guide parts" of the "at least one rear guide part" in this Aspect.

(Aspect 11)

The power tool further comprises a driving mechanism configured to be driven by the motor and to linearly drive the tool accessory, the tool body includes a motor housing part that houses the motor, and the driving-mechanism housing part that houses the driving mechanism, and the cover part is configured to cover at least a portion of the motor housing part.

The driving mechanism 75 is an example of the "driving mechanism" in this Aspect. The motor housing part 23 and the driving-mechanism housing part 21 are examples of the "motor housing part" and the "driving-mechanism housing part", respectively, in this Aspect.

DESCRIPTION OF THE REFERENCE NUMERALS

1: rotary hammer, 2: tool body, 21: driving-mechanism housing part, 23: motor housing part, 23L: left portion, 23R: right portion, 231: front portion, 25: first spring receiving part, 251: protrusion, 252: contact surface, 29: bellows part, 3: handle, 3L: left member, 3R: right member, 5: guide part, 5F: front guide part, 5R: rear guide part, 31: cover part, 31L: left wall part, 31R: right wall part, 33: grip part, 331: trigger, 335: switch, 337: power cord, 35: second spring receiving part, 351: base part, 352: contact surface, 354: protrusion, 41: biasing member, 411: first end portion, 412: second end portion, 51: guide recess, 53: guide protrusion, 55: elastic member, 55F: front elastic member, 55R: rear elastic member, 551: notch, 57: holder, 71: motor, 711: motor shaft, 713: fan, 75: driving mechanism, 79: tool holder, 91: tool accessory, A1: driving axis, A2: rotational axis, A3: rotational axis, P1: plane, P2: plane

What is claimed is:

1. A power tool having a hammer mechanism configured to linearly drive a tool accessory along a driving axis defining a front-rear direction, the power tool comprising:

a tool body extending along the driving axis;

a motor housed in the tool body and including a motor shaft, the motor shaft being rotatable around an axis parallel to the driving axis;

a handle (i) connected to the tool body to be pivotable relative to the tool body and to be movable in at least the front-rear direction relative to the tool body and (ii) including a cover part and a grip part, the cover part having a cylindrical shape at least in part and covering a portion of the tool body, the grip part extending in a cantilever manner from the cover part in a direction intersecting the driving axis;

at least one biasing member (i) between the tool body and the handle and (ii) configured to bias the tool body and the handle away from each other in the front-rear direction; and at least one guide part, the at least one guide part includes (i) at least one front guide part and (ii) at least one rear guide part that is closer to the grip part than the at least one front guide part in the front-rear direction;

each of the at least one guide part including (i) a first portion of the tool body covered by the cover part, (ii) a second portion of the cover part of the handle and connected to the first portion to be movable in at least the front-rear direction relative to the first portion, (iii)

an elastic member that elastically connects the first portion and the second portion, and (iv) a holder configured to hold the elastic member, wherein:

a first one of the first and second portions of each of the at least one guide part is a recess or a through hole that extends in the front-rear direction;

a second one of the first and second portions is a protrusion that protrudes into and is slidable within the recess or the through hole; and an elastic deformation property of the elastic member of the at least one front guide part is different from elastic deformation property of the elastic member of the at least one rear guide part.

2. The power tool as defined in claim 1, wherein the at least one guide part is configured to allow the handle to move relative to the tool body in the front-rear direction and in a direction intersecting the driving axis.

3. The power tool as defined in claim 1, wherein the at least one guide part includes two guide parts that are in symmetry relative to a plane containing the driving axis and extending in an extension direction of the grip part.

4. The power tool as defined in claim 1, wherein the first one of the first and second portions is configured to hold the elastic member to be movable in the front-rear direction relative to the second one of the first and second portions.

5. The power tool as defined in claim 4, wherein:

the elastic member has an annular shape, and the protrusion is within the elastic member.

6. The power tool as defined in claim 5, wherein a first part of an inner peripheral surface of the elastic member and a second part of an outer peripheral surface of the protrusion do not contact each other.

7. The power tool as defined in claim 4, wherein:

the holder is a metal holder, is between the elastic member and the first one of the first and second portion, and is slidable in the front-rear direction relative to the first one of the first and second portions.

8. The power tool as defined in claim 1, wherein the elastic member of the at least one front guide part is configured to be less deformable than the elastic member of the at least one rear guide part.

9. The power tool as defined in claim 1, wherein the at least one biasing member includes two biasing members that are on a plane containing the axis of the motor shaft and that are in symmetry relative to the axis parallel to the driving axis.

10. The power tool as defined in claim 1, wherein:

the elastic member is around the protrusion, and the elastic member is movable in the front-rear direction within the recess or the through hole.

11. The power tool as defined in claim 10, wherein:

the holder is a metal holder and the metal holder is slidable in the front-rear direction within the recess or the through hole.

12. A power tool having a hammer mechanism configured to linearly drive a tool accessory along a driving axis defining a front-rear direction, the power tool comprising:

a tool body extending along the driving axis;

a motor housed in the tool body and including a motor shaft, the motor shaft being rotatable around an axis parallel to the driving axis;

a handle (i) connected to the tool body to be pivotable relative to the tool body and to be movable in at least the front-rear direction relative to the tool body and (ii) including a cover part and a grip part, the cover part having a cylindrical shape at least in part and covering a portion of the tool body, the grip part extending in a cantilever manner from the cover part in a direction intersecting the driving axis;

at least one biasing member (i) between the tool body and the handle and (ii) configured to bias the tool body and the handle away from each other in the front-rear direction; and at least one guide part, each of the at least one guide part including (i) a first portion of the tool body covered by the cover part, (ii) a second portion of the cover part of the handle and connected to the first portion to be movable in at least the front-rear direction relative to the first portion, and (iii) an elastic member that elastically connects the first portion and the second portion, wherein:

a first one of the first and second portions of the at least one guide part is a recess or a through hole that extends in the front-rear direction, a second one of the first and second portions is a protrusion that protrudes into the recess or the through hole, the elastic member is around the protrusion, the elastic member is movable in the front-rear direction within the recess or the through hole, the at least one guide part further comprises a metal holder that holds the elastic member, the metal holder is slidable in the front-rear direction within the recess or the through hole, the at least one guide part includes (i) at least one front guide part and (ii) at least one rear guide part that is closer to the grip part than the at least one front guide part in the front-rear direction, the elastic member of the at least one front guide part is configured to be less deformable than the elastic member of the at least one rear guide part, and the tool body and the handle are pivotable relative to each other with the at least one front guide part serving as a fulcrum.

13. The power tool as defined in claim 12, wherein:

the at least one front guide part includes two front guide parts that are in symmetry relative to a plane containing the driving axis and extending in an extension direction of the grip part, and the at least one rear guide part includes two rear guide parts that are in symmetry relative to the plane.

14. The power tool as defined in claim 13, wherein the at least one biasing member includes two biasing members that are on a plane containing the axis of the motor shaft and that are in symmetry relative to the axis of the motor shaft.

15. A power tool having a hammer mechanism configured to linearly drive a tool accessory along a driving axis defining a front-rear direction, the power tool comprising:

a tool body extending along the driving axis;

a motor housed in the tool body and including a motor shaft, the motor shaft being rotatable around an axis parallel to the driving axis;

a handle (i) connected to the tool body to be pivotable relative to the tool body and to be movable in at least the front-rear direction relative to the tool body and (ii) including a cover part and a grip part, the cover part having a cylindrical shape at least in part and covering a portion of the tool body, the grip part extending in a cantilever manner from the cover part in a direction intersecting the driving axis;

at least one biasing member (i) between the tool body and the handle and (ii) configured to bias the tool body and the handle away from each other in the front-rear direction; and at least one guide part, each of the at least one guide part including (i) a first portion of the tool body covered by the cover part, (ii) a second portion of the cover part of the handle and connected to the first portion to be movable in at least the front-rear direction relative to the first portion, (iii) an annular elastic member with a center hole and (iv) a metal holder that holds the annular elastic member, wherein:

a first one of the first and second portions of the at least one guide part is a recess or a through hole that extends in the front-rear direction;

a second one of the first and second portions is a protrusion that protrudes into the recess or the through hole;

the annular elastic member is around the protrusion such that the protrusion is in the center hole;

the annular elastic member is movable in the front-rear direction within the recess or the through hole; and the holder is slidable in the front-rear direction within the recess or the through hole.

* * * * *